US005117737A

United States Patent [19]

Kosson et al.

[11] Patent Number: 5,117,737

[45] Date of Patent: Jun. 2, 1992

[54] SPECTRALLY SELECTIVE TRANSPARENCY FOR BACKGROUND THERMAL MATCHING

[75] Inventors: Robert L. Kosson, Massapequa; Jonas A. Bilenas, Melville; Salvatore J. Attard, Huntington, all of N.Y.

[73] Assignee: Grumman Aerospace Corporation, Bethpage, N.Y.

[21] Appl. No.: 627,396

[22] Filed: Nov. 1, 1990

[51] Int. Cl.[5] ..... F41H 3/00

[52] U.S. Cl. ..... 89/36.01; 428/919; 89/36.04

[58] Field of Search ..... 47/17; 89/36.01, 36.04, 89/36.07; 428/919

[56] References Cited

U.S. PATENT DOCUMENTS 2,046,601 7/1936 Atkinson ..... 47/17
4,316,405 2/1982 Esposito ..... 47/17

FOREIGN PATENT DOCUMENTS 2611425 9/1988 France ..... 47/17
714638 9/1954 United Kingdom ..... 47/17

OTHER PUBLICATIONS

Duncan et al., "Selection of Greenhouse Covering Materials", Transactions of the ASAE, Jul. 1975, vol. 18, pp. 703-706.

*Primary Examiner*—Stephen C. Bentley
*Attorney, Agent, or Firm*—Richard G. Geib; Daniel J. Tick

[57] ABSTRACT

An enclosure covers equipment to be camouflaged from thermal or multi-spectral (thermal, radar visual) detection in spaced relation with the equipment. The enclosure is preferably semi-transparent plastic material sufficiently spaced from the equipment to permit natural convection, or forced airflow over the equipment. In one embodiment, the plastic material has a number of sides with a plurality of openings formed therein for entraining air and a top joining the sides. A chimney is formed in the top and an adjustable discharge damper is provided in the chimney for controlling the flow of air over the equipment. The airflow may be natural or controlled actively or semi-actively.

10 Claims, 3 Drawing Sheets

SPECTRALLY SELECTIVE TRANSPARENCY FOR BACKGROUND THERMAL MATCHING

BACKGROUND OF THE INVENTION

The present invetion relates to an infrared camouflage system.

Infrared or IR detection of thermally dissipating equipment on the ground, when viewed against a cluttered background, depends upon the equipment contrast temperature, defined as an effective apparent temperature difference between the equipment and adjacent background surfaces. Usually, the contrast temperature difference must be limited to the background clutter limits, which are about 4 or 5 degrees C duing the day and about 2° C. during the night. This must be done in such a way that these limits are maintained against any background such as, for example, soil, grass, trees, etc., and at all atmospheric conditions, including solar heating, wind cooling and intermittent cloud passage.

The thermal concealment requirement of meeting the aforestated clutter limits is difficult to meet in most instances, because apparent temperatures of different backgrounds differ from each other by as much as 20° C. or more due to such factor as ground moisture and transpiration from vegetation. Additionally, constrast temperature is significantly affected by transient enviromental effects such as variable solar radiation, cloud patterns, wind and time of year. The key problem is the difference between the transient thermal responses of targets and backgrounds. Unlike the man-made camoflaged targets, the backgrounds have comparatively high thermal time constants and, therefore, respond relatively slowly to the changes in enviromental conditions.

Traditional attempts to cope with the stated thermal concealment difficulties are largely based on a passive thermal camouflage approach. This usually involves altering target camouflage and camouflage netting characteristics to match the target apparent temperature as closely as possible to one or several similar backgrounds. Typically, this done by tailoring the camouflage coating emissivity and netting porosity to produce the closet thermal radiance match with the adjacent background scene for a particular set of enviromental and seasonal conditions. Thermal performance of a typical passively matched camouflage system is successful against some backgrounds, some of the time, but not against most backgrounds, most of the time. This illustrates the seemingly insurmountable limitations of the passive approaches to cope with the dynamics of multiple environmental conditions.

It has been attempted to achieve a more substantial thermal concealment improvement by considering some active or semi-active controls of natural of forced convection in conjunction with a semi-transparent camouflage. While active controls provide better performance, the semi-active controls are simpler and sometimes more suitable for lower priority equipment. Both active and semi-active controls for background thermal matching are addressed in this disclosure. The semi-transparent camouflage, characterized by a spectrally-selective transparency, is a common element of both actively and semi-actively controlled embodiments of this invention. The key feature of the spectrally-selective transparency of the camouflage material is that this material has a relatively high solar transmittance coupled with relatively low thermal transmittance.

A key problem with the current used porous net concept is that although it will block some of the thermal energy emitted by a thermally dissipating target, some percentage of this energy will escape directly through the holes in the netting. Although this is acceptable against some hotter backgrounds when considering only area-averaged radiance of the net target combination, it does permit partial direct viewing of the target to be concealed. A non-porous blanket, on the other hand, will completely block the target but would tend to be itself heated due to incident solarl radiation (insolation) and by the target below, without any convective cooling flow.

The principal object of the invention is to provide an infrared camouflage system of simple structure which functions naturally, or with augmented forced flow.

An object of the invention is to provide an infrared camouflage system which functions efficiently and effectively in a natural manner without the need for a power source.

Another object of the invention is to provide an infrared camouflage system which is devoid of blowers, fans, electrical wiring or a source of electrical energy and requires little, if any, maintenance.

Still another object of the invention is to use natural convection cooling for inducing outside airflow through air passages between semi-transparent camouflage and equipment to be protected.

Yet another object of the invention is to augment natural convection, when required, by air fan or other means for providing greater airflow through air passages between camouflage and equipment to be protected.

An object of the invention is to provide semiactive, or manually adjusted, or active (automatically-driven) controls for adjusting inlet and/or outlet openings for airflow.

Another object of the invention is to provide the contrast temperature sensing means in conjunction with active or semiactive controls for achieving a variable airflow and thereby maintaning the contrast temperatures within the background clutter limits.

Still another object of the invention is to provide an infrared camouflage system of simple structure which is inexpensive in cost and requires essentially no maintenance.

Yet another object of the invention is to provide an infrared camouflage system which is set up and removed with speed and facility and functions efficiently, effectively and reliably to protect equipment from IR detection.

An object of the invention is to provide an IR camouflage system which, although it is inexpensive in cost and handled, packed and transported with speed and facility, protects high value military equipment on the ground from IR detection.

Another object of the invention is to provide an IR camouflage system which occupies a very small space when packed for transport and is handled with great facility and speed to cover and uncover high value military equipment on the ground, thereby protecting such equipment from IR detection.

Still another object of the invention is to provide an IR camouflage system which may readily be combined with existing visual and radar concealment systems to achieve a multi-spectral protection with minimal impact on IR, radar and visual concealment.

BRIEF SUMMARY OF THE INVENTION

In accordance with the invention, a device for camouflaging enclosed equipment from thermal detection comprises a plastic material enclosure for covering equipment to be camouflaged from IR detection in spaced relation with the equipment.

The plastic material may be transparent or semi-transparent.

The plastic material is sufficiently spaced from the equipment to permit natural convection airflow over the equipment.

The plastic material has one or more louvers formed in at least part thereof.

The plastic material has a top and a chimney formed on the top to promote natural air circulation and to permit circulation discharge through said chimney. Either the louver opening or an adjustable discharge damper in the chaminey may be used to control the flow of air over the equipment.

In one embodiment of the invention, one or more louvers are distributed around the base of the plastic material, which extends upwards adjacent to the sides and top of the equipment. The top has a chimney formed therein. Either the louver opening or an adjustable damper at the top of the chimney controls the flow of air over the equipment.

In another embodiment, the plastic matererial has sides with a plurality of louvers formed therein for entraining air and a top joining the side. The top has a chimney formed therein. Either an adjustable damper at the top of the chimney or an adjustabhle louver opening controls the of air over the equipment.

In accordance with the invention, a device for camouflaging enclosed equipment from thermal detection comprises a plastic material enclosure for covering equipment to be camouflaged from thermal detection is spaced relation with the equipment. The plastic material is sufficiently spaced from the equipment to permit natural convection airflow over the equipment. The plastic material has one or more sides with a plurality of louvers formed therein, or without louvers, but with a bottom inlet formed therein for entraining air and a top joining the side.

The top phas a chimney formed therein. In one embodiment, an adjustable discharge damper in the chimney controls the flow of air over the equipment.

The plastic material may be transparent or semi-transparent.

In accordance with the invention, a device for camouflaging eclosed equipment from thermal detection comprises an enclosure of plastic material for covering equipment to be camouflaged from thermal detection is spaced relation with the equipment. The enclosure is semi-transparent and sufficiently spaced from the equipment to permit natural convection airflow over the equipment. The semi-transparent plastic material has one or more adjustable louvers distriubted around the base of the plastic material for entraining air and a top having a chimney therein joining the sides. Either the louvers openings or a damper in the chimney controls the flow of air over the equipment. The plastic material may be transparent or semi-transparent. The semi-transparent plastic material has a side with louvers therein for entraining air and a top having a chimney therein joining the sides.

The plastic material may be transparent.

A damper in the chimney may control the flow of air over the equipment.

Another unique component of the invention is that the spectrally-selective transparency can be used alone or in conjunction with natural convection or forced cooling to achieve various degrees of thermal concealment.

BRIEF DESCRIPTION OF THE DRAWINGS

In order that the invention may be readily carried into effect, it will now be described with reference to the accompanying drawings, wherein.

DETAILED DESCRIPTION OF PREFERRED EMBODIMENTS

Figure 1:
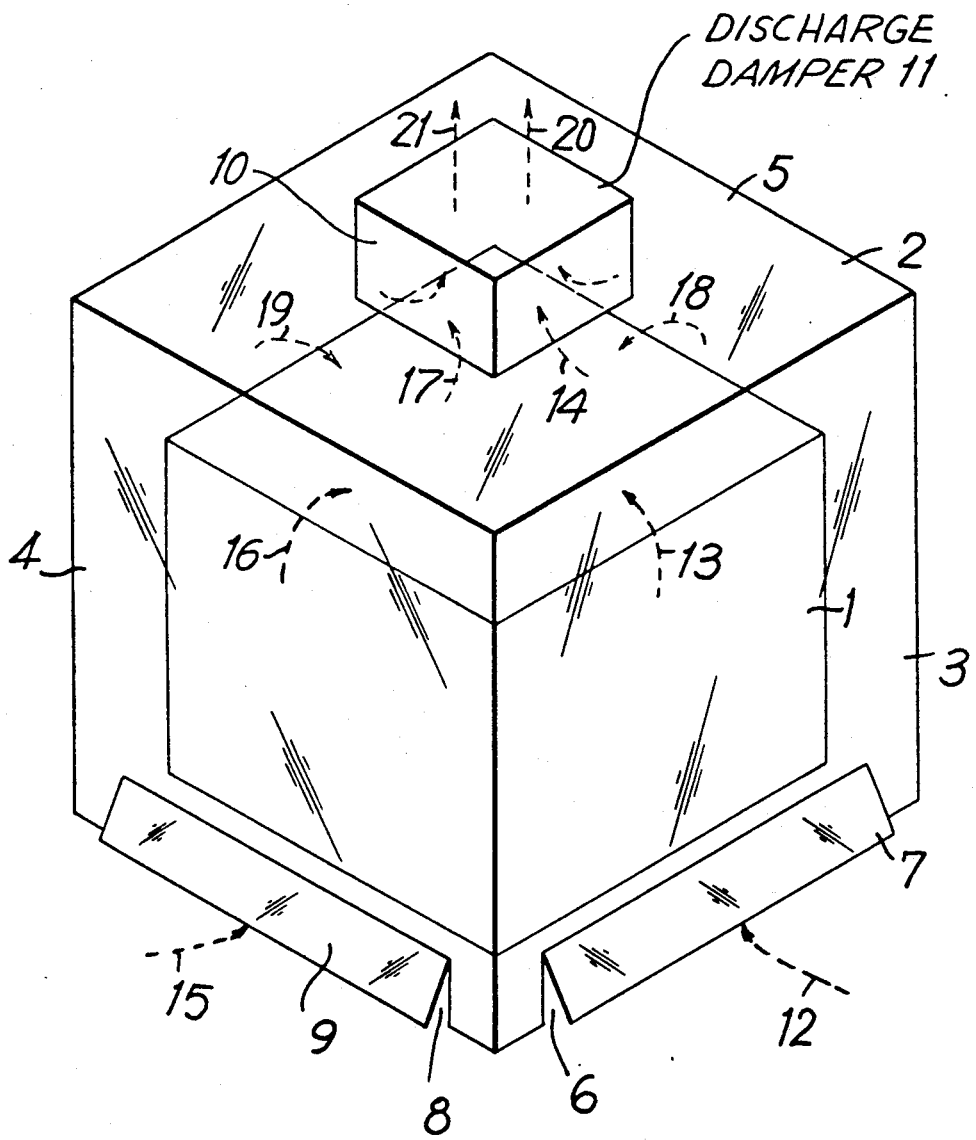
FIG. 1 is a perspective view of a first embodiment of the thermal camouflage system of the invention.

In accordance with the invention, clear plastic is used as the camouflage material. A clear plastic layer which is relatively transparent to sunlight and opaque at the longer wavelengths of the electromagnetic spectrum reduces the amount of solar radiation absorbed, permitting the surface to run cooler and thereby reducing IR (thermal) emissions. Since the clear plastic transmits most of the sunlight to the underlying equipment surfaces, said equipment will run somewhat hotter, but will bhe only partially visible in the IR bands because of the low IR transmittance of the plastic.

Several types of suitable plastic and their integrated average transmissivities (for particular thickness values) in the solar (0.2 to 4.0 micrometers) and IR (3.0 to 50.0 micrometers) regions are presented in Table 1. Typically, 5 mil thick MYLAR D (optically clear polyester sheet manufactured by DuPont) or 3 mil thick TEDLAR (polyvinylfluoride sheet, also by DuPont) are suitable, because of solar transmissivity, as well as the availability of detailed optical property information concerning these materials. Another feature of these spectrally selective plastics is their fairly low emissivity. TEDLAR, for example, has an emissivity of less than 0.6. Thus, not only do these platics transmit very little IR radiation, but they also have an emittance lower than most backgrounds. Therefore, the clear plastic layer is suitable and preferable for simulating the effect of cooler, transpiring vegetation or wet backgrounds. By using coatings, a partially opaque plastic layer would permit more solar heating to simulate warmer backgrounds such as soil, rock, and short grass.

TABLE I

| BRAND NAME | MATERIAL TYPE | THICKNESS (MILS) | SOLAR TRANS (%) | IR TRANS (%) | TEMP LIMITS (DEGREES F.) |
|---|---|---|---|---|---|
| LEXAN | POLYCARBONATE | 125 | 64.1 | 2.0 | 250-270 |
| PLEXIGLASS | ACRYLIC | 125 | 89.6 | 2.0 | 180-200 |
| TEFLON FEP | FLUOROCARBON | 5 | 92.3 | 25.6 | 400-475 |
| TEDLAR PVF | FLUOROCARBON | 3 | 92.2 | 20.7 | 225-350 |

TABLE I-continued

| BRAND NAME | MATERIAL TYPE | THICKNESS (MILS) | SOLAR TRANS (%) | IR TRANS (%) | TEMP LIMITS (DEGREES F.) |
|---|---|---|---|---|---|
| MLYAR 500D | POLYESTER | 5 | 86.9 | 17.8 | 300-400 |
| SUNLITER | FIBERGLASS | 25 | 87.5 | 3.3 | 200 |

Some of the merits of spectrally-selective plastics for use in thermal camouflage systems are known. The development of these materials, however, was for use as solar collector glazings which have very different requirements from thermal camouflage systems. These materials were desirable in solar collectors because they tended to trap thermal energy from the sun. Thermal camouflage should not significantly heat the target it is concealing. In fact, the camouflage should have provisions for permitting heat from both insolation and internal generation to escape.

Natural or free-convective cooling is advantageous, because it eliminates the need for a blower or fan. This is desirable for the reasons that blowers would add to the acoustic signature of the target, blowers require electricity, including all the associated wiring and circuitry, thereby adding to system complexity, blowers being mechanical devices, require maintenance, blowers tend to draw dust and moisture into the enclosure, necessitating the use of a filtration system and blowers generally add to the cost and complexity of a camouflage system.

In the natural convective cooling of the first and second embodiments of the invention, an air inlets or inlets are required to induce outside airflow in the generally upward direction. These embodiments also require a top outlet or outlets to allow air discharge. The outlet may be configured with or without a top chimney for enhanced natural convection flow. The natural convection may be used alone, or in conjunction with, forced airflow. Also, natural convection may be controlled actively or semi-actively by flow dampers, louvers or other flow impediment devices.

As shown in FIG. 1, the first embodiment of the device of the invention for camouflaging enclosed equipment 1 from thermal detection comprises an enclosure 2 for covering the equipment 1 to be camouflaged from thermal detection in spaced relation with said equipment. The enclosure 2 comprises plastic material of any suitable type, as hereinbefore discussed, sufficiently spaced from the equipment 1 to permit natural convection air flow over said equipment.

The plastic material 2 may be transparent or semi-transparent and, as hereinbefore discussed, is preferably semi-transparent and has a plurality of sides, of which sides 3 and 4 are shown in FIG. 1. The plastic enclosure 2 also has a top 5 joining the plurality of sides. Each side has an opening therethrough at the bottom thereof for entraining air. Thus, as shown in FIG. 1, the side 3 has an opening 6 therethrough which may be louvered by a louver 7 and the side 4 has an opening 8 therethrough which may be louvered by a louver 9.

A chimney 10 is provided in the top 5 and has an adjustable discharge damper 11 at its top for controlling the flow of air over the equipment 1.

Airflow over the equipment 1, as controlled by the thermal camouflage system of the embodiment of FIG. 1, is indicated by arrows 12, 13, 14, 15, 16, 17, 18, 19, 20 and 21. The semi-active controls of the second embodiment of the invention are manually-adjusted and function to increase or decrease airflow by simpler means than those of active controls. The semi-active controls may control airflow by opening, partially opening, or fully closing, air inlets or outlets. This can be achieved by louvered side walls, bottom inlet dampers, top outlet closure, or other means. Semi-active controls may be used alone or in conjunction with active controls.

Figure 2:
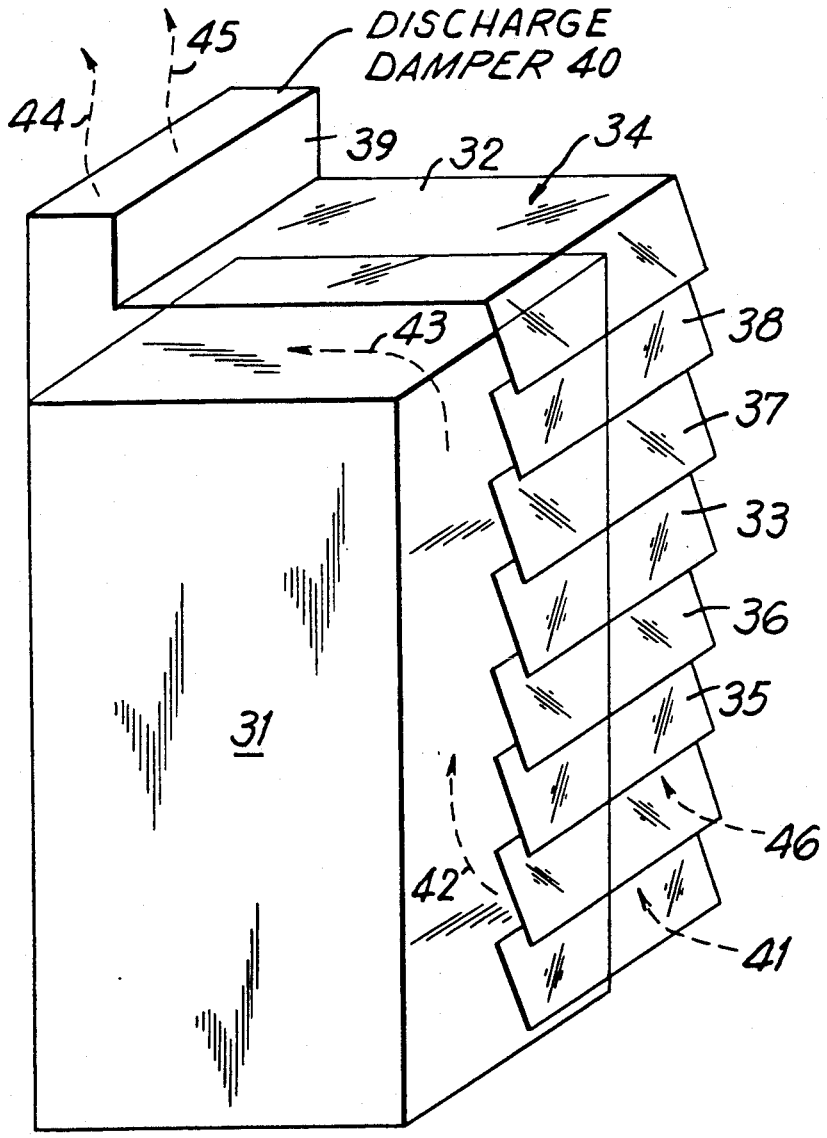
FIG. 2 is a perspective view of a second embodiment of the thermal camouflage system of the invention.

As shown in FIG. 2, the second embodiment of the device of the invention for camouflaging enclosed equipment 31 from thermal detection comprises an enclosure 32 for covering the equipment 31 to be camouflaged from thermal detection in spaced relation with said equipment. As in the first embodiment, of FIG. 1, the enclosure 32 comprises plastic material of any suitable type, as hereinbefore discussed, sufficiently spaced from the equipment 31 to permit natural convection airflow over said equipment.

The plastic material 32 may be transparent or semi-transparent and, as hereinbefore discussed, is preferably semi-transparent and has a plurality of sides, of which only a single side 33 is shown in FIG. 2. The plastic enclosure 32 also has a top 34 joining the plurality of sides. Each side has a plurality of louvers or openings 35, 36, 37, 38 and so on, therein for entraining air.

A chimney 39 is provided in the top 34 and has an adjustable discharge damper 40 at its top for controlling the flow of air over the equipment 31.

Airflow over the equipment 31, as controlled by the thermal camouflage system of the embodiment of FIG. 2, is indicated by arrows 41, 42, 43, 44, 45 and 46.

The louvered semi-transparent plastic enclosure takes advantage of the benefits of the plastic and natural convection. The louvers 35, 36, 37, 38, and so on, can provide full upper-hemisphere geometric blockage of a hot target while permitting natural convection and entrainment airflow to enter freely into the space between the enclosure 32 and the equipment 31.

Active controls may be coupled to radiometric sensors and flow control means to measure contrast temperature difference and, accordingly, to increase or decrease airflow, as required. The active controls may be used alone or in combination with semi-active controls.

Forced cooling requires some air fan or other means of inducing airflow through air passages between the semi-transparent camouflage sheet and this equipment. The forced airflow may be used alone or in conjunction with the natural convection. Also the forced cooling flow may be controlled by either active or semi-active controls.

Figure 3:
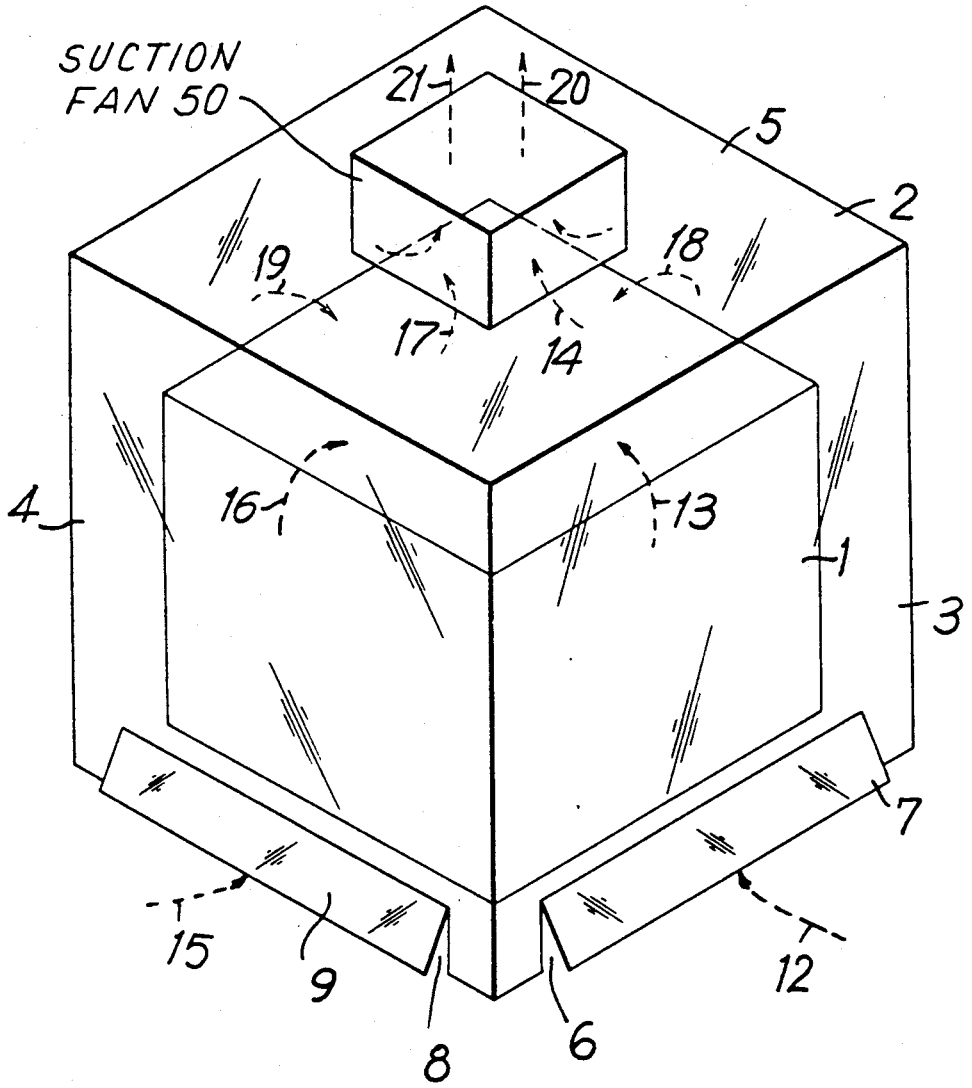
FIG. 3 is a perspective view of a modification of the first embodiment of the invention.

As shown in FIG. 3, the third embodiment of the device of the invention for camouflaging enclosed equipment 1 from thermal detection is the same as the first embodiment, shown in FIG. 1, with the exception that the chimney 10 and discharge damper 11 of said first embodiment are replaced by a suction fan 50 of any suitable known type in said third embodiment This, the third embodiment of the invention, as shown in FIG. 3, comprises the enclosure 2 for covering the equipment 1 to be camouflaged from thermal detection in spaced relation with said equipment. The enclosure 2 comprises plastic material of any suitable type, as hereinbefore discussed, sufficiently spaced from the equipment 1 to permit natural convection airflow over said equipment.

The plastic material 2 may be transparent or semi-transparent and, as hereinbefore discussed is preferably semi-transparent and has a plurality of sides, of which the sides 3 and 4 are shown in FIG. 3. The plastic enclosure 2 also has the top 5 joining the plurality of sides. Each side has an opening therethrough at the bottom thereof for entraining air. Thus, as shown in FIG. 3, the side 3 has an opening 6 therethrough which may be louvered by the louver 7 and the side 4 has an opening 8 therethrough which may be louvered by the louver 9.

The suction fan 50 is provided in the top 5 for controlling the flow of air over the equipment 1.

Airflow over the equipment 1, as controlled by the thermal camouflage system of the embodiment of FIG. 3, is indicated by arrows 12, 13, 14, 15, 16, 17, 18, 19, 20 and 21, as in FIG. 1.

The semi-transparent thermal camouflage may also be covered with a multi-spectral (visual and radar) camouflage net to achieve a multi-spectral (thermal, visual and radar) concealment with minimal impact on thermal, visual and radar concealment performance, as demonstrated in field tests.

Although the embodiment of FIG. 1 functions in a manner similar to that of the embodiment of FIG. 2, it is somewhat less affected by wind and offers some structural advantages.

The airflow may be varied by active or semiactive means. Thus, a variable airflow may be provided by any suitable known automatic drive system such as, for example, that shown and described in U.S. Pat. No. 4,609,034 of Robert Kosson, Jonas Bilenas and Salvatore Attard for Infrared Camouflage System. A variable airflow may be provided by any suitable manual means such as, for example, manual movement of the discharge damper 11 or manual movement of louvers 7, 9, 35, 36, 37 and 38, or any of them.

While the invention has been described by means of specific examples and in specific embodiments, we do not wish to be limited thereto, for obvious modifications will occur to those skilled in the art without departing from the spirit and scope of the invention.

We claim:

1. A device for camouflaging enclosed equipment from thermal detection by matching the apparatus temperature of an external surface of an enclosure with the apparent temperature of the adjacent background of the equipment, said device comprising an enclosure for covering equipment to be camouflaged from thermal detection in spaced relation with said equipment, said enclosure comprising plastic material, said plastic material having an external surface and being sufficiently spaced from said equipment to permit natural convection airflow over said equipment, said plastic material having opening means formed in at least part thereof and having a top and a chimney formed in said top and further comprising an adjustable discharge damper in said chimney for controlling the flow of air over said equipment, said plastic material being relatively transparent to sunlight and opaque at the longer wavelengths of the electromagnetic spectrum and thereby reducing the amount of solar radiation absorbed, permitting the surface to run cooler and thus reducing thermal emissions.

2. A device as claimed in claim 1, wherein said plastic material is substantially transparent.

3. A device as claimed in claim 1, wherein said plastic material is substantially semi-transparent.

4. A device as claimed in claim 1, wherein said plastic material has at least one side with a plurality of louvers formed therein for entraining air and a top joining the sides, said top having a chimney formed therein, and further comprising an adjustable damper at the top of said chimney for controlling the flow of air over said equipment.

5. A device for camouflaging enclosed equipment from thermal detection by matching the apparent temperature of an external surface of an enclosure with the apparent temperature of the adjacent background of the equipment, said device comprising an enclosure for covering equipment to be camouflaged from thermal detection in spaced relation with said equipment, said enclosure comprising plastic material sufficiently spaced from said equipment to permit natural convection airflow over said equipment, said plastic material having a plurality of sides having openings formed therein for entraining air and a top joining said sides and an opening formed in said top, wherein said top has a chimney formed therein at said opening in said top and further comprising an adjustable discharge damper in said chimney for controlling the flow of air over said equipment, said plastic material being relatively transparent to sunlight and opaque at the longer wavelengths of the electromagnetic spectrum and thereby reducing the amount of solar radiation absorbed, permitting the surface to run cooler and thus reducing thermal emissions.

6. A device as claimed in claim 5, wherein said plastic material is substantially transparent.

7. A device as claimed in claim 5, wherein said plastic material is substantially semi-transparent.

8. A device for camouflaging enclosed equipment from thermal detection by matching the apparent temperature of an external surface of an enclosure with the apparent temperature of the adjacent background of the equipment, said device comprising an enclosure of plastic material for covering equipment to be camouflaged from thermal detection in spaced relation with said equipment, said enclosure being substantially semi-transparent and sufficiently spaced from said equipment to permit an airflow over said equipment, said plastic material having a plurality of sides having openings formed therein for entraining air and a top joining said sides, said top having an opening formed therein; and suction means in said hole in said top for drawing air from outside said enclosure through said openings in said sides, over said equipment and out through said opening in said top, said plastic material being relatively transparent to sunlight and opaque at the longer wavelengths of the electromagnetic spectrum and thereby reducing the amount of solar radiation absorbed, permitting the surface to run cooler and thus reducing thermal emissions.

9. A device as claimed in claim 8, wherein said plastic material is substantially transparent.

10. A device as claimed in claim 8, wherein said openings in said sides have louvers thereat.

* * * * *